US006862989B2

(12) United States Patent
Belanger et al.

(10) Patent No.: US 6,862,989 B2
(45) Date of Patent: Mar. 8, 2005

(54) BLANKET CYLINDER WITH INTEGRATED COMPRESSIBLE LAYER

(75) Inventors: James Richard Belanger, Portsmouth, NH (US); Richard Karl Weiler, Durham, NH (US)

(73) Assignee: Goss International Americas, Inc., Dover, NH (US)

( * ) Notice: Subject to any disclaimer, the term of this patent is extended or adjusted under 35 U.S.C. 154(b) by 0 days.

(21) Appl. No.: 09/955,826

(22) Filed: Sep. 19, 2001

(65) Prior Publication Data

US 2003/0205156 A1 Nov. 6, 2003

(51) Int. Cl.[7] ..... B41F 13/10

(52) U.S. Cl. ..... 101/375; 101/376; 101/216; 101/217

(58) Field of Search ..... 101/375, 376, 101/217, 216, 487, 488; 492/4

(56) References Cited

U.S. PATENT DOCUMENTS

| | | | | | |
|---|---|---|---|---|---|
| 3,253,323 | A | * | 5/1966 | Saueressing | 492/4 |
| 3,295,188 | A | * | 1/1967 | Saueressig | 492/4 |
| 4,030,415 | A | * | 6/1977 | Fellows | 101/382.1 |
| 4,044,669 | A | * | 8/1977 | Luther | 101/127.1 |
| 4,135,677 | A | * | 1/1979 | Warczak | 242/571.1 |
| 4,150,622 | A | * | 4/1979 | Stollenwerk et al. | 101/378 |
| 4,327,467 | A | | 5/1982 | Quaint | 29/113 |
| 4,381,709 | A | * | 5/1983 | Katz | 101/375 |
| 4,807,527 | A | * | 2/1989 | Knauer | 101/216 |
| 4,968,100 | A | * | 11/1990 | Corneil | 299/21 |
| 5,481,975 | A | * | 1/1996 | Schulz | 101/375 |
| 5,507,228 | A | * | 4/1996 | Schulz | 101/375 |
| 5,694,848 | A | * | 12/1997 | Palmatier | 101/219 |
| 5,784,957 | A | * | 7/1998 | Rau et al. | 101/142 |
| 5,840,386 | A | * | 11/1998 | Hatch et al. | 428/36.9 |
| 6,161,478 | A | * | 12/2000 | Katz | 101/375 |
| 6,202,556 | B1 | * | 3/2001 | Lagger | 101/216 |

* cited by examiner

*Primary Examiner*—Andrew H. Hirshfeld
*Assistant Examiner*—Andrea H. Evans
(74) *Attorney, Agent, or Firm*—Davidson, Davidson & Kappel, LLC

(57) ABSTRACT

A printing unit including a rigid cylinder rotatable about an axis of rotation, a plurality of inflatable bladders disposed on a circumferential surface of the cylinder, and a first fluid supply regulation unit configured to supply a first fluid to a first set of inflatable bladders of the plurality of inflatable bladders and to regulate a first fluid pressure inside the first set inflatable bladders. In addition, a method for mounting a sleeve-shaped printing sock onto a blanket cylinder of an offset printing press, in which a set of inflatable bladders disposed at an outer region of the blanket cylinder are at least partially deflated. The sleeve-shaped printing sock is slid over one end of the blanket cylinder so that the printing sock at least partially surrounds a circumference of the blanket cylinder. The set of inflatable bladders are then inflated so that the printing sock fits tightly around the circumference of the blanket cylinder.

13 Claims, 2 Drawing Sheets

BLANKET CYLINDER WITH INTEGRATED COMPRESSIBLE LAYER

BACKGROUND OF THE INVENTION

The present invention relates generally to printing presses and more particularly to a blanket cylinder including an integrated compressible layer.

Offset lithographic printing presses, for example, have a plate cylinder and a blanket cylinder for transferring images from a printing cylinder to a web of material, such as paper.

The circumferential surface of the blanket cylinder is typically covered with a multi-layer compressible blanket having an outer print layer which receives the images from the printing plate and transfers them onto the web of material. The blanket may be a flat material wrapped around and secured to the blanket cylinder, or, in the case of gapless printing presses, it may be a sleeve-shaped material for slipping over one end of the blanket cylinder.

Printing blankets in the prior art include a print layer, a layer of reinforcing cord, a compressible layer, a base cord, and a sleeve which contacts a metal circumferential surface of the blanket cylinder. A blanket is typically between about 0.050 inches and about 0.100 inches thick. Sleeve-shaped blankets having this construction can be especially bulky to ship and store. Their multi-layer construction makes them difficult to manufacture and expensive. Also, current multi-layer blankets lose pliancy (i.e. stiffness) and gage (i.e. diameter) over time due to degradation of the matrix material, especially the compressible material. Once the printing blankets degrade sufficiently, they are disposed of, and a new blanket is mounted to the blanket cylinder. In the past, attempts have been made to overcome some of these deficiencies by adjusting the geometry and material properties of the compressible layer.

U.S. Pat. No. 4,327,467 relates to an inflated shell structure for use with other types of industrial rollers, such as curing, embossing or film winding rollers having a rubber cover wrapped around the roller. According to the shell structure of the '467 patent, a rubber tube is spirally wound around a mandrel and kept in place by an adhesive. A multi-layer bridge composite is adhesively mounted to the outside of the ruber tube. At least two layers of the bridge composite includes wire cords and the cords in at least one layer are axially aligned with the mandrel. A thin rubber cover covers the outside surface of the multi-layer bridge composite. An inflation means inflates the tube and maintains the tube under pressure.

BRIEF SUMMARY OF THE INVENTION

The present invention provides a printing unit that includes a rigid cylinder rotatable about an axis of rotation and a plurality of inflatable bladders disposed on a circumferential surface of the cylinder. A fluid supply regulation unit is configured to supply a fluid to a set of inflatable bladders of the plurality of inflatable bladders and to regulate a first fluid pressure inside the first set inflatable bladders. A flexible cover is disposed over an outer surface of the plurality of bladders.

The flexible cover may include a single-layer material and may be disposed adjacent to the outer surface of the plurality of bladders. A printing sock, which may be sleeve-shaped, may be removably disposed over a circumferential surface of the flexible cover.

The printing unit may also include a second fluid supply regulation unit configured to supply a second fluid to a second set of inflatable bladders from the plurality of inflatable bladders and to regulate a second fluid pressure inside the second set of inflatable bladders. The printing unit may also include a first fluid line connecting the first fluid supply regulation unit to the first set of bladders and a second fluid line connecting the second fluid supply regulation unit to the second set of inflatable bladders. The first and second fluid lines include a rotary union configured to enable the first and second fluid to flow through the first and second fluid lines while the cylinder is rotating about the axis. The first and second fluid supply regulation units may be configured to regulate the first and second fluid pressures while the cylinder is rotating about the axis. The first and second fluids may include air or a hydraulic fluid.

The printing unit may also include a first heat exchanger connected to the first fluid regulation unit and wherein the first regulation unit is configured to circulate the first fluid between the first set of inflatable bladders and the first heat exchanger. Each of the bladders may be ring-shaped and encircle the cylinder.

The present invention also provides a method for mounting a sleeve-shaped printing sock onto a blanket cylinder of an offset printing press. The method includes at least partially deflating a set of inflatable bladders disposed at an outer region of the blanket cylinder, positioning the sleeve-shaped printing sock over one end of the blanket cylinder so that the printing sock at least partially surrounds a circumference of the blanket cylinder, and inflating the set of inflatable bladders so that the printing sock fits tightly around the circumference of the blanket cylinder.

The method may also include adjusting a fluid pressure inside the set of inflatable bladders according to a desired printing quality and control of web feed characteristics and location while rotating.

BRIEF DESCRIPTION OF THE DRAWINGS

Similar Elements are Numbered Similarly in the Figures.

DETAILED DESCRIPTION

Figure 1:
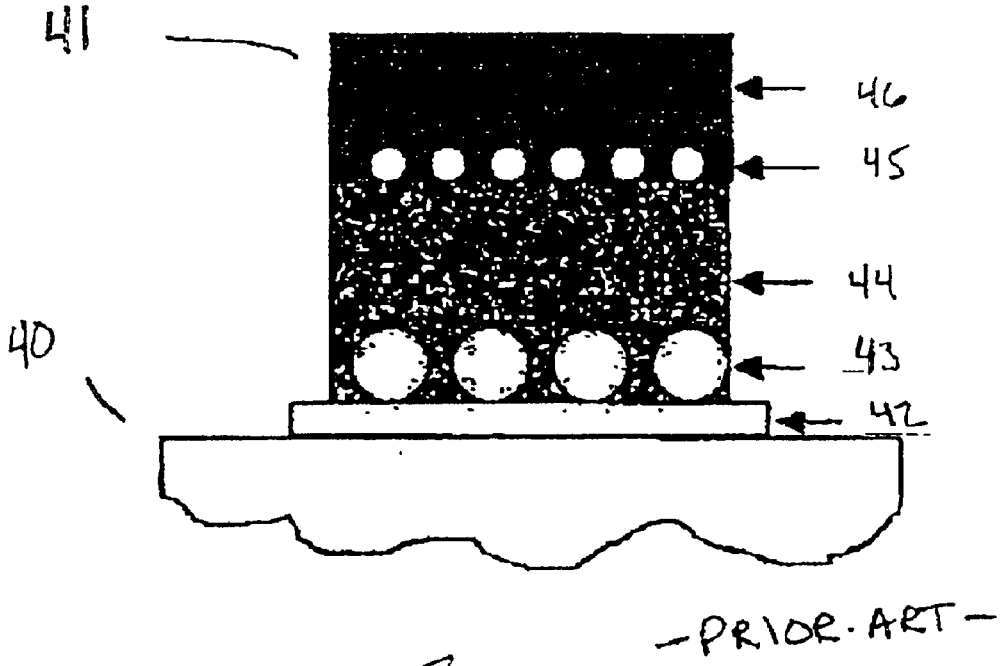
FIG. 1 shows a partial schematic cross-section of a typical blanket cylinder and a printing blanket known in the prior art.

FIG. 1 shows a schematic partial cross-section of a prior art blanket cylinder 40 having a prior art printing blanket 41 disposed thereon. Prior art printing blanket includes multiple layers. Sleeve 42 is disposed directly adjacent to blanket cylinder 40 and is permanently bonded to the rubber layers surrounding it. Base cord 43 is disposed adjacent to sleeve 42 and may include cotton or polymer thread aligned around the circumference of blanket cylinder 40. Compressible layer 44 may be made of nitrile foam rubber and is bonded to and surrounds base cord 43. Reinforcing cord may include cotton or polymer threads aligned circumferentially around an outer region of the compressible layer. Print layer 46 is bonded to the outside of reinforcing cord 45. Base cord and reinforcing cord provide stability and strength to the multi-layer blanket structure resulting in a more stable print surface.

High speed printing causes the compressible layer to repeatedly contract and expand as the print layer comes in contact with the print roller and the web. The repeated contraction and expansion of the compressible layer causes the material to degrade, losing its ability to expand to its original form and, thus, becoming thinner and less pliant. Eventually the entire printing blanket 41, including all of layers 42–46 must be disposed of, and a new printing blanket mounted to the blanket cylinder.

Figure 2:
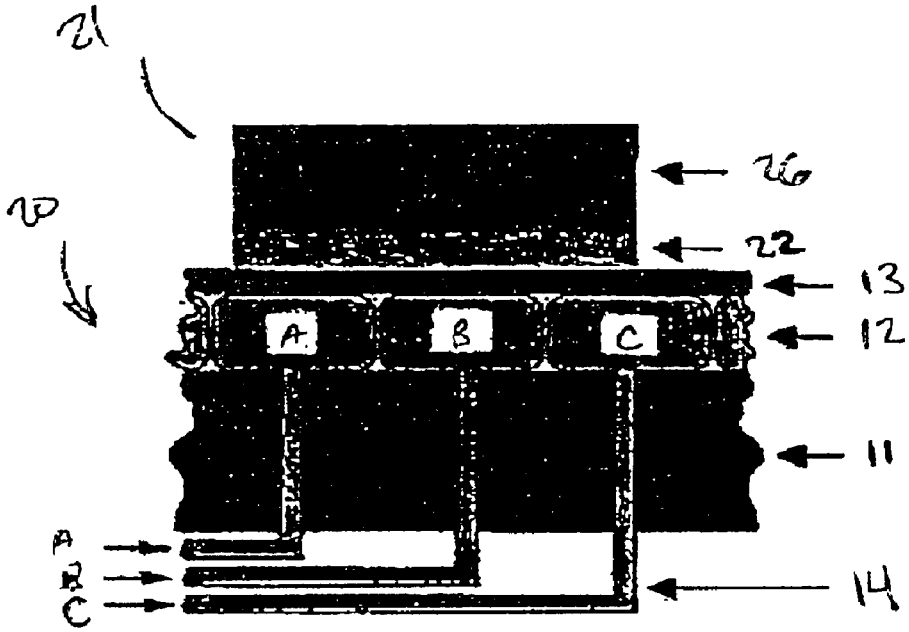
FIG. 2 shows a partial schematic cross-section of a preferred embodiment of a blanket cylinder and printing sock according to the present invention.

FIG. 2 shows a partial schematic cross-section of blanket cylinder 20 and printing sock 21 according to the present invention. Printing sock 21 may include print layer 26 and reinforcing layer 22. Reinforcing layer 22, however, is not required for adequate functioning of the invention and may be omitted depending on the circumstances.

Blanket cylinder 20 includes cylinder 11, which may be made of a rigid material such as a metal. Bladders 12 are disposed on a circumferential surface of cylinder 11. Bladders 12 may be ring-shaped so that each bladder encircles the circumference of cylinder 11. Bladders 12 are inflatable and may be filled with a fluid A, B, and C, which may be the same or different fluids. The fluid may include air, other gases, water, or other hydraulic fluids. Fluid lines 14 connect bladders 12 to fluid supply regulation units (not shown in FIG. 2). Each of fluid lines A, B, and C may go to the same fluid supply regulation unit or to different fluid supply regulation units so that the pressure inside of the bladders may be individually regulated. Cylinder covering 13 is disposed on the outer surface of bladders 12 to form the outside covering of blanket cylinder 20.

Regulation of pressure of fluids A, B, and C inside bladders 12 affect both the compressibility of blanket cylinder 20, but also its effective diameter. Thus a sleeve-shaped printing sock 21 may be easily mounted on blanket cylinder 20 by first deflating bladders 12, slipping printing sock 21 over an end of blanket cylinder 20, and then inflating bladders 12 to increase the diameter of blanket cylinder 20 and provide sufficient pressure to printing sock 21 to hold it tightly to the outside of the cylinder.

The bladders 12 in FIG. 2 provide the required compressibility for the printing sock 21. Thus printing sock 41 does not require compressible layer 44 to provide the compressibility.

Figure 3:
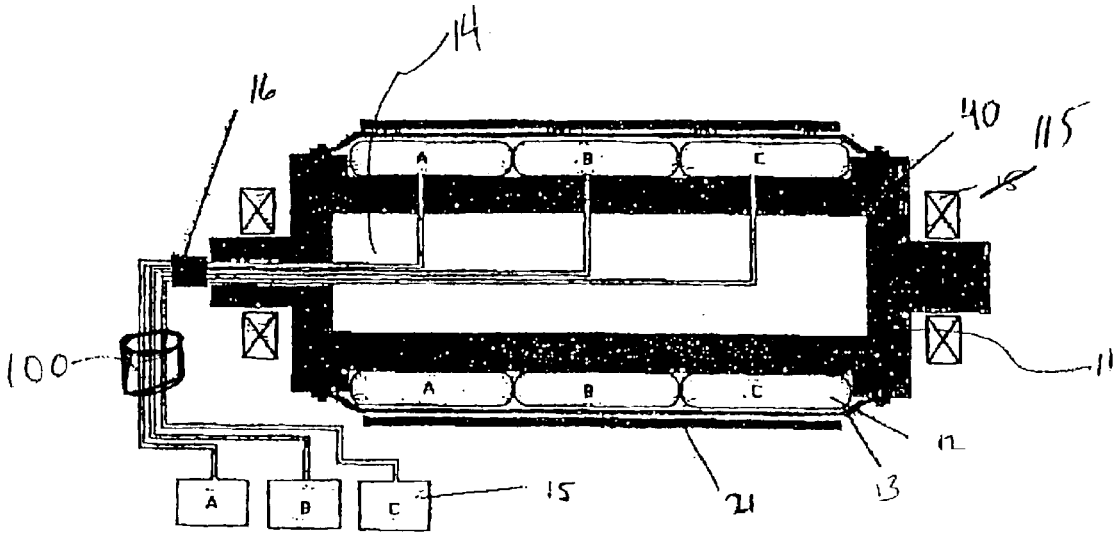
FIG. 3 shows a full schematic view the blanket cylinder and printing sock according to the present invention.

FIG. 3 shows a schematic cross-section of blanket cylinder 20 and printing sock 21 according to the present invention. Rigid cylinder 11 is rotatably supported by bearings 115. Bladders 12 are ring-shaped and encircle the circumference of rigid cylinder 11. Cylinder covering 13 is attached at its axial ends to rigid cylinder 11, for example by riveting. Fluid lines 14 connect bladders 12 to fluid supply regulation units 15. A rotary union 16 is used to enable cylinder 11 to rotate without interrupting the flow of fluid. Thus, fluid pressure in the bladders 12 can be adjusted while the printing press is running and while the blanket cylinder 20 is rotating. In this embodiment each of the three bladders A, B, and C are individually connected to three different fluid supply regulation units, which can individually regulate the pressure of fluid in the bladders. Thus, the working pressure in each zone (as defined by the width of each bladder) can be adjusted during operation based on print quality requirements and press conditions.

During operation, waste heat is generated in the nip where the print layer of the print sock comes into contact with the web. Much of this heat can be removed by the web itself. However, in the case of a narrow web, heat generated in end regions of the blanket cylinder where there is no web could be removed by circulating the fluid within the appropriate bladders and cooling it in a heat exchanger 100. For example heat exchanger 100 may be connected to (or part of) the fluid supply regulation unit 15, or otherwise connected to fluid lines 14. A temperature feedback loop could be set up to help ensure a constant temperature across the entire nip.

The fluid supply regulation units 15 could be further configured to quickly deflate the bladders 12 in the case of a break in the web. This would reduce the chances of damage during web break conditions. Presently, the blanket cylinder is moved on its axis of rotation away from the web when it is desired to stop printing on the web. According to the present invention this function could also be carried out by deflating bladders 12. This would allow blanket cylinders to have fixed axes and therefore greatly reduce the number of moving parts and costs of the printing unit.

"Printing sock" as defined herein may be any tubular structure operable for transferring ink on an outer surface.

What is claimed is:

1. A blanket cylinder in combination with a sleeve-shaped printing sock comprising:

a rigid cylinder;

at least one inflatable bladder disposed on a circumferential surface of the cylinder;

a flexible cylinder covering disposed over an outer surface of the at least one inflatable bladder;

a sleeve-shaped printing sock, the sleeve-shaped printing sock configured to be removably disposed over a circumferential surface of the flexible cover, the sleeve-shaped printing sock including a print layer; and a fluid supply regulation unit, the fluid supply regulation unit regulating a fluid pressure inside the at least one inflatable bladder to alter a compressibility of the blanket cylinder.

2. The blanket cylinder in combination with the printing sock as recited in claim 1 wherein the at least one bladder includes a plurality of bladders.

3. The blanket cylinder in combination with the printing sock as recited in claim 1 wherein the fluid supply regulation unit is connected to a first set of a plurality of bladders of the at least one bladder.

4. The blanket cylinder in combination with the printing sock as recited in claim 3 further comprising a second fluid supply regulation unit configured to supply a second fluid to a second set of inflatable bladders of the at least one inflatable bladder and to regulate a second fluid pressure inside the second set of inflatable bladders.

5. The blanket cylinder in combination with the printing sock as recited in claim 4 further comprising a first fluid line connecting the first fluid supply regulation unit to the first set of bladders and a second fluid line connecting the second fluid supply regulation unit to the second set of inflatable bladders.

6. The blanket cylinder in combination with the printing sock as recited in claim 5 wherein the first and second fluid supply regulation units are configured to regulate the first and second fluid pressures while the cylinder is rotating about the axis.

7. The blanket cylinder in combination with the printing sock as recited in claim 4 wherein first and second fluid lines include a rotary union configured to enable the first and second fluid to flow through the first and second fluid lines while the cylinder is rotating about the axis.

8. The blanket cylinder in combination with the printing sock as recited in claim 1 wherein the fluid supply regulation unit regulates air.

9. The blanket cylinder in combination with the printing sock as recited in claim 1 wherein the flexible cylinder covering includes a single-layer material and is disposed adjacent to the outer surface of the at least one bladder.

10. The blanket cylinder in combination with the printing sock as recited in claim 1 further comprising a first heat exchanger connected to the first fluid regulation unit and wherein the first regulation unit is configured to circulate a first fluid between the inflatable bladder and the first heat exchanger.

11. A method for mounting a sleeve-shaped printing sock onto a blanket cylinder of an offset printing press, the method comprising:

at least partially deflating an inflatable bladder disposed at an outer region of the blanket cylinder;

positioning the sleeve-shaped printing sock over one end of the blanket cylinder so that the printing sock at least partially surrounds a circumference of the blanket cylinder;

inflating the inflatable bladder so that the printing sock fits tightly around the circumference of the blanket cylinder; and adjusting a compressibility of the blanket cylinder.

12. The method as recited in claim 11 further comprising adjusting a fluid pressure inside the at least one inflatable bladder to set a desired printing quality.

13. The method as recited in claim 11 wherein the compressibility is adjusted during a printing operation.

* * * * *